US005094335A

United States Patent [19]

Adrian et al.

[11] Patent Number: 5,094,335

[45] Date of Patent: Mar. 10, 1992

[54] STEP CHAIN ROLLER FOR CURVED ESCALATOR

[75] Inventors: Willy Adrian, Obernkirchen; Bernd David, Minden; Klaus Seehausen, Niedernwohren, all of Fed. Rep. of Germany

[73] Assignee: Otis Elevator Company, Farmington, Conn.

[21] Appl. No.: 757,866

[22] Filed: Sep. 11, 1991

[51] Int. Cl.[5] ..... B66B 21/02

[52] U.S. Cl. ..... 198/328

[58] Field of Search ..... 198/328, 778

[56] References Cited

U.S. PATENT DOCUMENTS 4,681,206 7/1987 Sugita ..... 198/328

4,809,840 3/1989 Nakatani ..... 198/328

*Primary Examiner*—D. Glenn Dayoan

*Attorney, Agent, or Firm*—William W. Jones

[57] ABSTRACT

In a curved escalator which has a return step run which is below the passenger-bearing run, the reversal step chain sprockets are of different diameters, the outer step chain sprockets being larger than the inner step chain sprockets. Since the steps are all tied together by the inner and outer step chains, the two chains must engage the inner and outer reversal sprocket teeth as the steps reverse their direction of movement. This results in a tipping of the step axles and steps during the turn-around, whereby a problem relating to engagement between the step chain rollers attached to the step axles and the sprocket teeth can occur. In order to maximize area contact between the tipped step chain rollers and the horizontal sprocket teeth, the step chain rollers which engage the sprocket teeth are formed with an external base-to-base truncated conical profile. This ensures that 50% of the surface of each profile roller will fully engage the sprocket teeth on the reversal sprockets.

4 Claims, 2 Drawing Sheets

STEP CHAIN ROLLER FOR CURVED ESCALATOR

DESCRIPTION

1. Technical Field

This invention relates to an improved step chain axle roller configuration for use in a curved escalator, which roller configuration provides enhanced surface contact with the sprocket teeth on the escalator reversal sprockets.

2. Background Art

U.S. Pat. No. 4,730,717 granted Mar. 15, 1988 to K. Sugita; and U.S. Pat. No. 4,746,000 granted May 24, 1988 to H. Nakatani, et al., disclose curved escalators of the type which have step return paths which are disposed below the passenger carrying paths. Since the escalator follows a curved path of travel, the outer edge of the steps must travel faster than the inner edge of the steps. The solution to this problem offered by the above-noted patents is a single drive shaft powered by an electric motor on which are mounted two drive sprockets, one inner and one outer, which drive sprockets engage the inner and outer step chains respectively. The outer drive sprocket has a larger diameter than the inner drive sprocket, thus it will move the outer step chain faster than the inner drive sprocket moves the inner step chain.

The two drive sprockets, as well as the idler sprockets at the opposite end of the escalator will engage the rollers on the step chains. Each of the steps will have step axles on which guide rolls are mounted, which guide rolls move over inner and outer tracks on the escalator. The sprockets will also engage these step axles as the steps reverse their direction of movement. Since the sprockets have different diameters, the step axles will tilt as the steps pass over the sprockets. The tilting of the step axles on the sprockets causes a problem which relates to the manner in which the sprocket teeth engage the step axles. Normally, the valleys between the sprocket teeth will be cut perpendicular to the sides of the sprocket. This arrangement is fine when the step axles stay horizontal, but when the step axles tilt, minimal engagement between the step chain axle rollers and the sprocket teeth will result. The aforesaid two patents provide three different solutions for this problem. The 4,746,000 patent discloses the use of a bent step axle, or the use of pivoting bushings on the step chain axle rollers when the step axle is straight. The 4,730,717 patent discloses the solution of cutting the sprocket teeth valleys which engage the step chain axle rollers at an angle, which conforms to the angle of tilt of the step axles. The solutions to the problem offered by the prior art involve atypical and specialized step axles or chain sprockets on one hand, or complex step chain rollers on the other hand.

DISCLOSURE OF THE INVENTION

This invention relates to a simplified solution to the problem of the tilted step axles which utilizes conventionally cut sprocket teeth and conventionally formed step chain axle rollers, and does not require complex movement of the step chain axle rollers when they engage the sprocket teeth. The chain rollers which are fitted on the step axles are provided with a conventional grease bushing which directly overlies the step axle, and onto which is fitted a sleeve which has an outer convex surface when viewed in axial sectional view.

The convex surface can be curvilinear, but is preferably formed with base-to-base frustocones, due to ease of manufacture. The diameter of the sleeve is thus greatest at its midplane, and smallest at its ends. This outer configuration when formed at an angle conforming to the angle of tilt of the step axles in the reversal zones will ensure that about 50% of the external area of the sleeve will abut face-to-face the sprocket tooth valleys when the latter are cut at right angles to the sides of the sprockets. The double cone shape allows the escalator to be assembled without concern as to how the sleeves are oriented when they are fixed to the step axles.

It is therefore an object of this invention to provide an improved step chain for use in a curved escalator that ensures adequate sprocket contact at the step axles.

It is a further object of this invention to provide a step chain of the character described which does not require atypically cut sprocket teeth.

It is an additional object of this invention to provide a step chain of the character described which does not require a swiveling step chain axle roller.

These and other objects and advantages of the invention will become more readily apparent from the following description of a preferred embodiment of the invention when taken in conjunction with the accompanying drawings, in which:

BEST MODE FOR CARRYING OUT THE INVENTION

Figure 2:
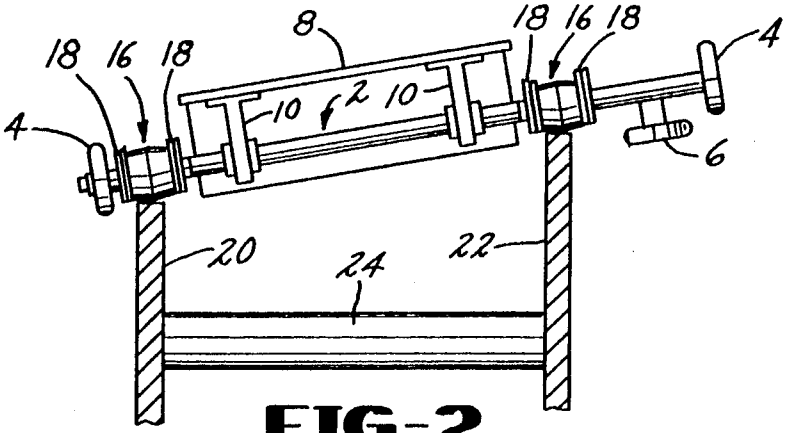
FIG. 2 is a fragmented elevational view partly in section of one of the reversal sprocket sets showing the tipping of the steps as they pass over the sprockets.
Figure 1:
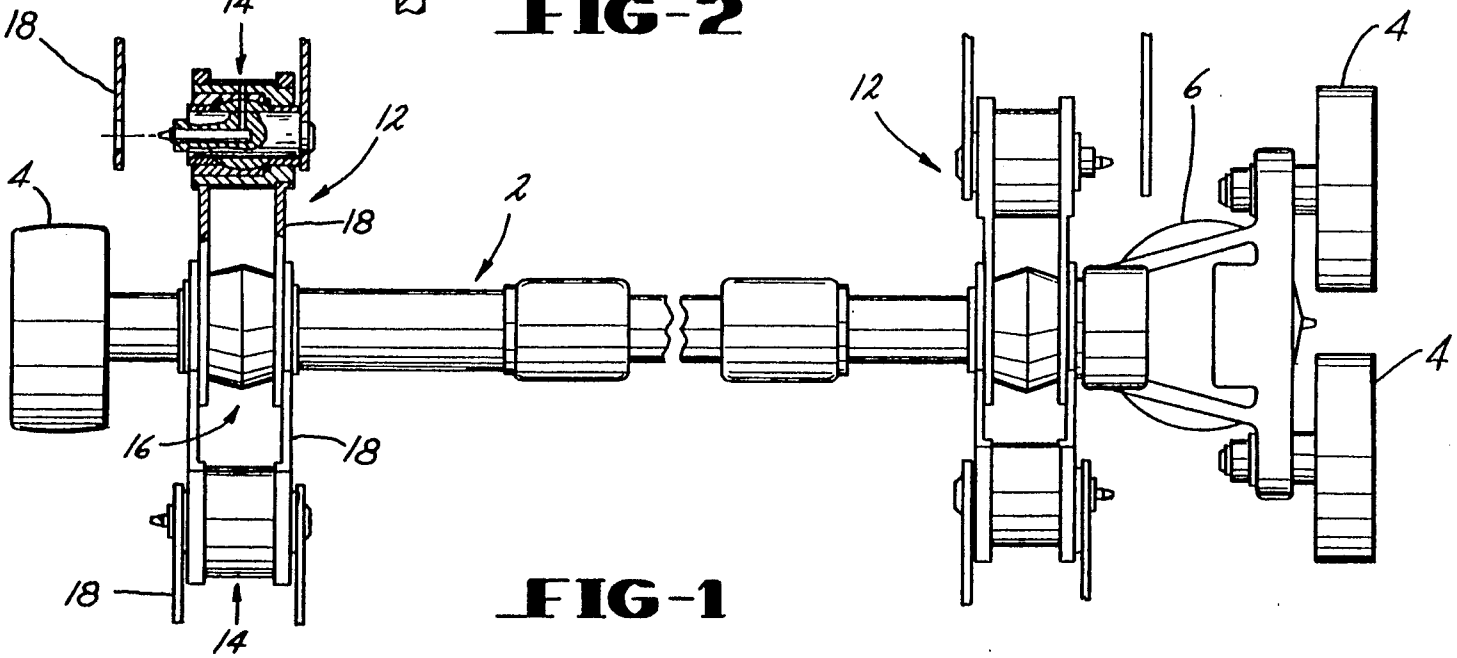
FIG. 1 is a fragmented sectional view of an escalator step chain and step axle having a preferred embodiment of the step chain axle roller of this invention.

Referring now to the drawings, there is shown in FIGS. 1 and 2 an escalator step axle 2 adapted for use in a curved escalator. The axle 2 carries track-engaging guide rolls 4, and a thrust roll 6 which engages a side of the outer track and resists forces induced by the curvature of the escalator path of travel which tend to pull the steps and chain in toward the center of the path of travel of the escalator. The axle 2 is connected to the escalator step 8 by means of brackets 10 depending from the bottom of the step 8. The escalator has inner and outer step chains 12 which are connected to end parts of the step axle 2. Each chain 12 includes a plurality of universally pivotable rollers 14 which provide the necessary flexibility to the chains 12 between adjacent step axles 2 so as to allow the chains 12 to follow the curved path of travel of the escalator. The universal rollers 14 are connected to each other and to step chain axle rollers 16 by links 18. As seen in FIG. 2, the step chain axle rollers 16 engage the sprockets 20 and 22 which are of unequal size as denoted by radii $r_1$ and $r_2$, and which are mounted on a common shaft 24.

Figure 4:
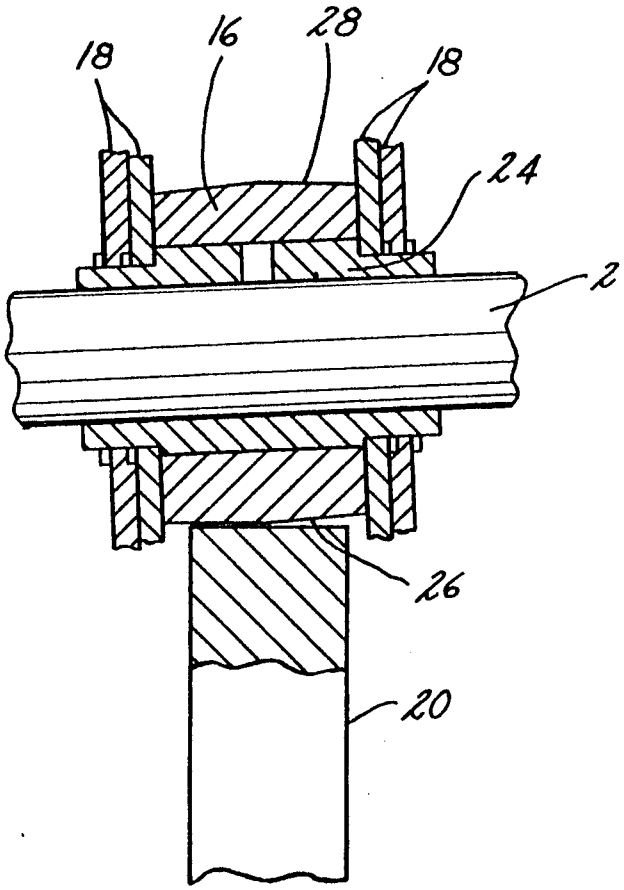
FIGS. 3 and 4 are fragmented sectional views showing the manner of engagement between the step chain axle roller and the sprocket teeth.
Figure 3:
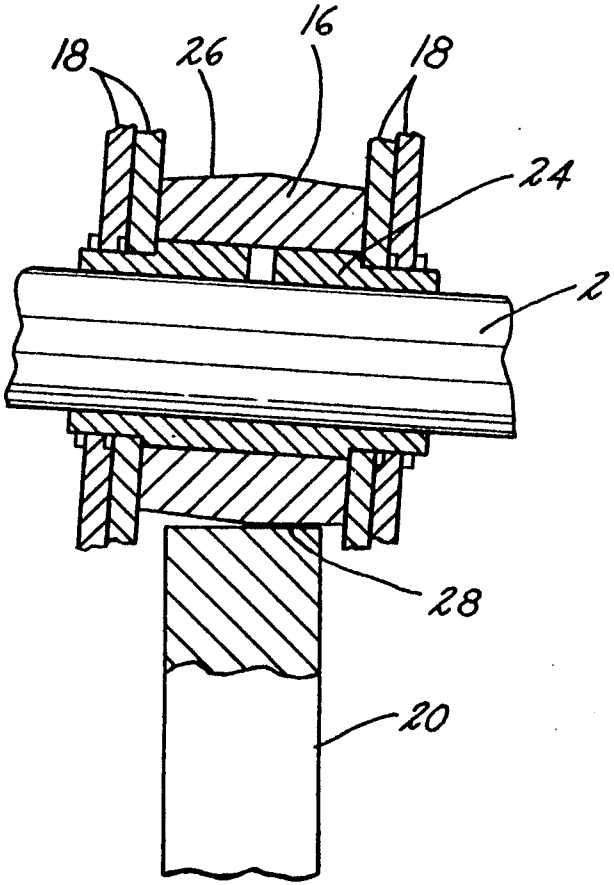

As will be seen in FIGS. 3 and 4, the step chain axle roller sleeve 17 is mounted on a grease fitting or bearing 24, which is mounted on the step axle 2. The rollers 16 do not pivot or otherwise move on the fitting 24 or on the axle 2. The outside surface of the sleeves 17 has a convex profile preferably formed by base-to-base frustoconical surfaces 26 and 28. The angle of inclination of the frustocones is related to the difference in the sprocket radii $r_1$ and $r_2$ and the distance between the sprockets 20 and 22 so as to compensate for the angle of tilt of the step axle. It will be noted from FIG. 3 that when the frustoconical side 28 engages the sprocket 20, the proper angle of axle tilt will be established in one direction, and from FIG. 4, when the side 26 engages the sprocket 20, the proper angle of axle tilt will be established to the other side. Thus the tilting of the axle resulting from bringing the step chains 12 around the sprockets 20 and 22 automatically places one of the roller surfaces 26 and 28 in surface-to-surface contact with the sprocket teeth. This is accomplished without requiring a misshapened step axle, and without a complex swiveling step chain axle roller structure.

It will be appreciated that the step chain axle rollers contemplated by this invention are of relatively simple construction; durable; easily mounted on the step axles; and do not require any particular spatial orientation when the step chain is assembled on the step axles.

Since many changes and variations of the disclosed embodiment of the invention may be made without departing from the inventive concept, it is not intended to limit the invention otherwise than as required by the appended claims.

What is claimed is:

1. A step chain for use in a curved escalator of the type having a step return path disposed below a passenger carrying path, and having return sprockets at either end of the escalator of unequal size, said step chain comprising a series of links joined together at serial flexible link rollers, and spaced apart step axle rollers for mounting on step axles on the escalator, said step axle rollers being formed with an external convex return sprocket-engaging surface which provides enhanced area contact with the return sprockets despite tilting of the step axles at the return sprockets.

2. The step chain of claim 1 wherein the external surface of said step axle rollers is formed with two base-to-base truncated conical surfaces for engagement with the return sprockets.

3. A curved escalator of the type having a step return path disposed below a passenger carrying path, said escalator comprising:

a) a plurality of steps each of which includes a step axle carrying step guide rollers;

b) inner and outer step chains connecting adjacent steps, each of said inner and outer step chains having step chain axle rollers mounted on said step axles;

c) a pair of step chain return sprockets mounted at each landing of the escalator for guiding the step chains and steps between the passenger carrying path and the return path, each pair of return sprockets including an outer sprocket having a larger diameter than an inner sprocket paired therewith, and each of said inner and outer return sprockets having sprocket teeth which are cut at right angles to sides of said sprockets; and d) each of said step chain axle rollers having an external sprocket-engaging surface which is convexly formed to maximize area contact between said step chain axle rollers and said sprocket teeth as said step chains pass over said return sprockets.

4. The escalator of claim 3 wherein said sprocketen-gaging surface of each of said step chain axle rollers is formed with base-to-base adjacent frustoconical surfaces, one of which engages the sprocket teeth as the step chain passes over the return sprockets.

* * * * *

UNITED STATES PATENT AND TRADEMARK OFFICE

CERTIFICATE OF CORRECTION

PATENT NO. : 5,094,335

DATED : March 10, 1992

INVENTOR(S) : Willy Adrian, et al.

It is certified that error appears in the above-identified patent and that said Letters Patent is hereby corrected as shown below:

Col. 4

In Claim 4, line 1, delete "sprocketen-" and insert "sprocket-en-" in lieu thereof.

Signed and Sealed this

Twenty-first Day of September, 1993

Bruce Lehman

*Attest:*

BRUCE LEHMAN

*Attesting Officer*

*Commissioner of Patents and Trademarks*